US005927584A

United States Patent [19]

Akiba

[11] Patent Number: 5,927,584

[45] Date of Patent: Jul. 27, 1999

[54] PNEUMATIC FASTENER DRIVING TOOL HAVING AIR EXHAUST ARRANGEMENT

[75] Inventor: Yoshitaka Akiba, Hitachinaka, Japan

[73] Assignee: Hitachi Koki Co., Ltd., Tokyo, Japan

[21] Appl. No.: 09/053,765

[22] Filed: Apr. 2, 1998

[30] Foreign Application Priority Data

Apr. 18, 1997 [JP] Japan ..... 9-101774

[51] Int. Cl.[6] ..... B25C 1/04

[52] U.S. Cl. ..... 227/130; 173/DIG. 2

[58] Field of Search ..... 227/130, 8, 156; 173/DIG. 2

[56] References Cited

U.S. PATENT DOCUMENTS

| | | | |
|---|---|---|---|
| 4,139,137 | 2/1979 | Gupta | 227/110 |
| 4,206,687 | 6/1980 | Klaus et al. | 227/130 |
| 4,667,572 | 5/1987 | Elliesen | 227/130 |
| 4,778,015 | 10/1988 | Jacobsson | 173/DIG. 2 |
| 5,110,030 | 5/1992 | Tanji | 227/130 |
| 5,259,465 | 11/1993 | Mukoyama | 227/130 |
| 5,485,946 | 1/1996 | Jankel | 227/130 |

FOREIGN PATENT DOCUMENTS

| | | | |
|---|---|---|---|
| 59-105379 | 7/1984 | Japan | B25C 1/04 |
| 59-97882 | 7/1984 | Japan | B25C 1/04 |

*Primary Examiner*—Scott A. Smith

*Attorney, Agent, or Firm*—Sughrue, Mion, Zinn, Macpeak & Seas, PLLC

[57] ABSTRACT

A compressed air exhaust arrangement in a pneumatic fastener driving tool. An exhaust port is formed in an upper portion of a main body, and a cover member is fixed onto the upper portion. An annular muffler member is disposed between the cover member and an upper surface of the main body to surround the exhaust port. The cover member has a lower surface formed with a plurality of cranked grooves for providing a plurality of air vent passages relative to an upper surface of the muffler member. The air vent passage allows the compressed air from the exhaust port to pass therethrough toward an atmosphere. Before freeze of the muffler member, most of the compressed air discharged through the exhaust port directly passes through the muffler member. After freeze of the muffler member, the compressed air passes through the air vent passage.

14 Claims, 3 Drawing Sheets

PNEUMATIC FASTENER DRIVING TOOL HAVING AIR EXHAUST ARRANGEMENT

BACKGROUND OF THE INVENTION

The present invention relates to a pneumatic fastener driving tool having an air exhaust arrangement, and more particularly, to the exhaust arrangement capable of weakening exhaust stream and reducing exhaust sound.

A pneumatic fastener driving tool urges an internal drive piston downwardly through a drive source such as a compressed air for driving a nail etc. into a wall or other intended location. The drive piston is reciprocally movable, and therefore, the compressed air applied to an upper portion of the drive piston must be discharged to an atmosphere during return stroke of the piston. To this effect, an exhaust port is formed at an upper portion of the driving tool for allowing the compressed air to be discharged outside. Due to the high pressure and rapid flow of the compressed exhaust air passing through the exhaust port, ambient dust or debris may be blown up by the compressed exhaust air stream, and further, loud or noisy exhaust sound may occur.

U.S. Pat. No. 5,110,030 discloses a cap formed with an exhaust port. The cap is rotatable with respect to an upper end portion of a main body in which the drive piston is reciprocally disposed. By manual rotation of the cap, angular position of the exhaust port can be changed, so that the exhaust air can be directed toward an intended direction for avoiding blowing-up of the dust or debris.

Further, in order to weaken the exhaust stream and to reduce the exhaust noise, a muffler member formed of an open cell type porous material is provided at the exhaust port as disclosed in a Japanese Utility Model application Kokai Nos. Sho-59-97882 and Sho-59-105379.

However, if the compressed air is frequently discharged due to the increased frequency of nail driving operation, adiabatic expansion occurs when the compressed air is discharged through the exhaust port to cool the exhaust port and the muffler member, which causes freezing of the muffler member. By this freezing, clogging occurs at the muffler, to prevent the exhaust air from passing therethrough. Thus, the fastener driving tool does not work.

SUMMARY OF THE INVENTION

It is therefore an object of the present invention to provide a pneumatic fastener driving tool provided with an improved arrangement capable of weakening exhaust air stream and reducing exhaust sound without any freezing of a muffler member.

Another object of the present invention is to provide such pneumatic fastener driving tool in which frequent driving operation can be constantly performed with high reliability.

These and other objects of the present invention will be attained by a pneumatic fastener driving tool including a main body formed with an exhaust port, a cylinder disposed in the main body, a drive piston reciprocally movably disposed in the cylinder, a drive bit connected to the drive piston for driving a fastener in one direction, a cover member attached to the main body portion, and a muffler member. A compressed air is applied to the drive piston for its movement in the one direction. The muffler member is fixed at a position by the cover member and at a position outwardly of the exhaust port for allowing the compressed air which has been passing through the exhaust port to pass through the muffler member toward an atmosphere. At least one air vent passage is formed between a peripheral surface of the muffler member and one of the cover member and the main body for permitting the compressed air which has been passing through the exhaust port to be discharged toward the atmosphere through the air vent passage.

In another aspect of the present invention, there is provided a pneumatic fastener driving tool including a main body having an upper portion formed with an exhaust port, a cylinder disposed in the main body and extending in an axial direction and having an upper open end, a drive piston, a head valve, a cover member, and a muffler member. The drive piston is reciprocally movably disposed in the cylinder for driving a fastener in one direction. A compressed air is applied to the drive piston for its movement in the one direction. The head valve is disposed within the main body and at a position above the cylinder. The head valve is movable in the axial direction of the cylinder for selectively closing and opening the exhaust port and opening and closing the upper open end of the cylinder. The cover member is attached onto the upper portion of the main body portion. The muffler member is fixed at a position by the cover member and at a position radially outwardly of the exhaust port for allowing the compressed air which has been passing through the exhaust port to pass through the muffler member toward an atmosphere. At least one air vent passage is formed between a peripheral surface of the muffler member and one of the cover member and an upper surface of the main body for permitting the compressed air which has been passing through the exhaust port to be discharged toward the atmosphere through the air vent passage.

DETAILED DESCRIPTION OF THE PREFERRED EMBODIMENTS

Figure 1:
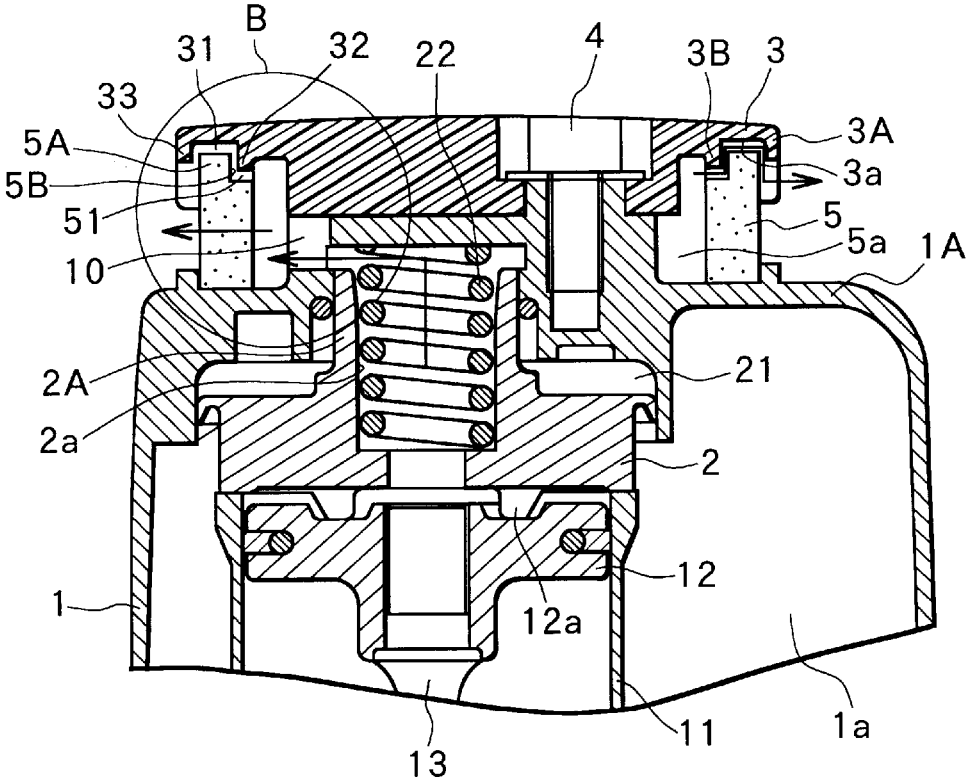
FIG. 1 is a cross-sectional view showing an upper essential portion of a pneumatic fastener driving tool according to a first embodiment of the present invention.
Figure 2:
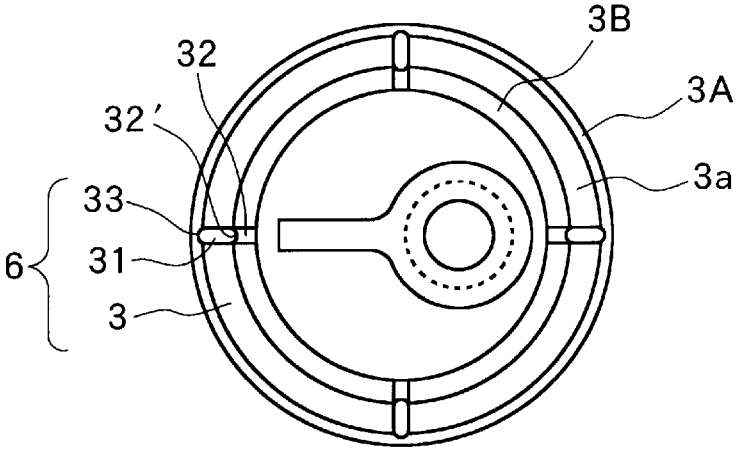
FIG. 2 is a bottom view showing a cover member according to the first embodiment.

A pneumatic fastener driving tool according to a first embodiment of the present invention will be described with reference to FIGS. 1 through 4.

The driving tool generally includes a main body 1 defining therein a compressed air chamber 1*a* for accumulating a compressed air supplied from a compressor (not shown). The main body 1 has a top wall portion 1A. In the main body 1, a cylinder 11 is provided in which a drive piston 12 is slidably disposed. Further, a drive bit 13 is disposed integrally with the drive piston 12 for ramming or driving a fastener such as a nail.

A head valve 2 is disposed above the cylinder 11 for selectively closing and opening an upper open end of the cylinder 11. The head valve 2 is movable in an axial direction of the cylinder 11. The upper sleeve portion 2A has a central bore 2*a* and has an uppermost end selectively contactable with a lower surface of the top wall 1A. Further, a compression spring 22 is disposed within the central bore 2*a* of the upper sleeve portion 2A and is interposed between the top wall 1A and the head valve 2 for normally urging the head valve 2 downwardly so as to maintain air tight arrangement between the head valve 2 and an upper edge of the cylinder 11. A piston chamber 12*a* is defined within the cylinder 11 and between the head valve 2 and the drive piston 12.

The central bore 2*a* of the upper sleeve portion 2A is in fluid communication with the piston chamber 12*a*. The compressed air chamber 1*a* is outside the cylinder 11. Because compressed air is applied into the compressed air chamber 1*a,* the compressed air pressure urges the head valve 2 upwardly against the biasing force of the compression spring 22.

At a lower portion of the main body 1, a fastener injection passage (not shown) is provided through which the fastener and the drive bit 13 pass. A magazine (not shown) is provided at the lower portion of the main body 1 for accommodating therein the fasteners. The nail feeding portion (not shown) is provided for successively feeding the nails from the magazine to the fastener injection passage.

A head valve chamber 21 is defined between the upper wall portion 1A of the main body 1 and the head valve 2. Further, a trigger (not shown) is provided for starting a fastener driving operation upon manipulation thereof. The trigger is associated with a trigger valve (not shown) for selectively applying compressed air or atmospheric air to the head valve chamber 21.

Further, the upper wall 1A of the main body 1 is formed with an exhaust port 10 for discharging compressed air in the piston chamber 12*a* to the atmosphere through the upper sleeve portion 2A after driving operation.

A cover member 3 formed of a plastic material is fixed by a bolt 4 to the upper wall portion 1A and at a position above the exhaust port 10. An outer peripheral end surface of the cover member 3 extends radially outwardly from an open end of the exhaust port 10 of the main body 1. Further, an annular muffler member 5 is interposed between the outer peripheral end portion of the cover member 3 and an upper surface of the upper wall portion 1A, and an annular space 5*a* is defined within the annular muffler member 5. With this arrangement, an inner peripheral surface of the muffler member 5 is in communication with and in confrontation with the open end of the exhaust port 10. The muffler member 5 is made of a gas transmissible porous material such as a felt and an urethane foam.

In order to fix the annular muffler member 5 at a fixed position, at the radially outer peripheral end of the lower surface of the cover member 3, an outermost downwardly projecting annular protrusion 3A and an inner downwardly projecting annular protrusion 3B are formed. Further, An annular groove 3*a* is defined between the annular protrusions 3A and 3B. On the other hand, the annular muffler member 5 has an upper end face provided with an outermost upwardly projecting annular protrusion 5A engageable with the annular groove 3*a,* and an inner stepped portion 5B to which a lower end of the inner downwardly projecting annular protrusion 3B is seated. On the other hand, a lower end face of the muffler member 5 is flat which is in intimate contact with an upper flat surface of the upper wall 1A.

At least one air vent passage 6 is defined between the lower surface of the cover member 3 and an upper surface of the muffler member 5. In the depicted embodiment four air vent passages 6 are formed. More specifically, upper and lower end faces of the muffler member 5 is hermetically sealed with respect to the lower surface of the cover member 3 and the upper surface of the top wall portion 1A, respectively, except the air vent passages 6.

To form the air vent passages 6, the lowermost surface of the inner protrusion 3B is formed with a groove 32 extending in a radial direction. Further, a second groove 32' extending in an axial direction and in communication with the radial groove 32 is formed at an outer vertical surface of the inner protrusion 3B. Further, a bottom of the annular groove 3*a* is formed with a radial groove 31 in communication with the vertical groove 32'. Furthermore, the inner vertical wall of the outermost protrusion 3A is formed with a vertical groove 33 in communication with the radial groove 31.

With this arrangement, if the trigger is manipulated, compressed air in the head valve chamber 21 is discharged, so that the head valve 2 is moved upwardly because of the applied compressed air pressure in the compressed air chamber 1*a,* and the head valve 2 is separated from the upper edge of the cylinder 11. Accordingly, the compressed air can be introduced into the piston chamber 12*a* to pneumatically move the drive piston 12 downwardly. In this case, the upper end of the upper sleeve portion 2A is seated against the top wall 1A of the main body 1. Therefore, the exhaust port 10 is closed by the upper sleeve portion 2A, so that the compressed air in the piston chamber 12 cannot be discharged outside.

The drive piston 12 is rapidly urged downwardly by the compressed air, so that the fastener is driven downwardly into the workpiece by way of the drive bit 13. Then after releasing the trigger, compressed air is introduced into the head valve chamber 21, so that the head valve 2 is moved downwardly in co-operation with the compression spring 22, and finally the head valve 2 is seated on the upper edge of the cylinder 11 to block fluid communication between the compressed air chamber 1*a* and the piston chamber 12*a*. Simultaneously, the upper edge of the upper sleeve portion 2A is moved away from the upper wall 1A of the main body 1, so that the exhaust port 10 is brought into fluid communication with the piston chamber 12*a* through the bore 2*a* of the upper sleeve portion 2A.

Figure 3:
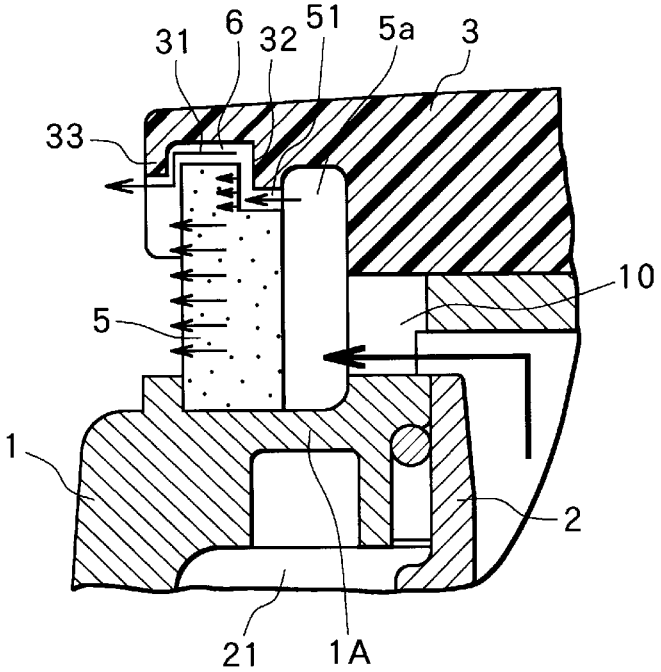
FIG. 3 is an enlarged cross-sectional view showing a compressed air exhausting state before freeze of a muffler member according to the first embodiment.
Figure 4:
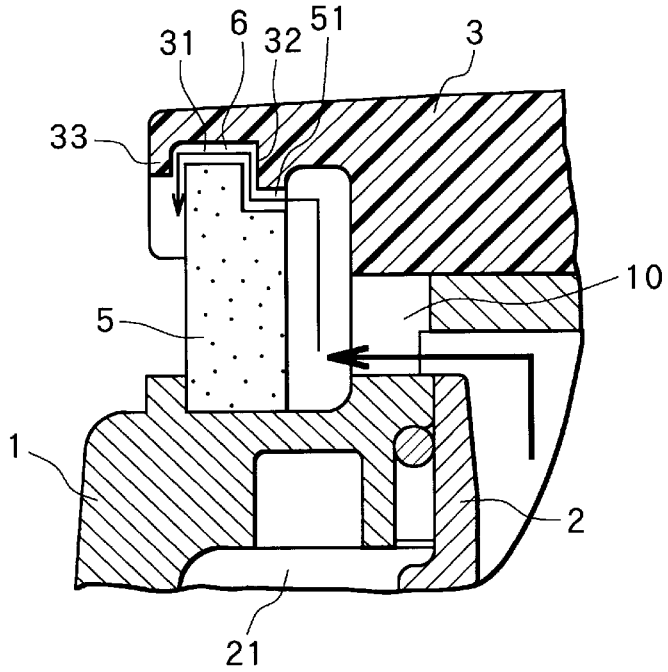
FIG. 4 is an enlarged cross-sectional view showing the compressed air exhausting state after freeze of the muffler member according to the first embodiment.

The exhaust air passing through the exhaust port 10*a* is then flowing into the annular space 5*a,* and almost all the exhaust air is discharged outside through the muffler member 5 as shown by arrows in FIG. 3. Thus, exhaust air stream can be weakened and exhaust noise can be reduced by the muffler member 5. Further, a minor part of the exhaust air does not passes through the muffler member 5 but direcly flows through the air vent passages 6 to the atmosphere. However, since each air vent passage 6 has a crank shape, the exhaust air discharged out of the air vent passage 6 was impinged on the inner peripheral surface of the muffler member 5, the lower surface of the top wall 1A, the inner vertical surface of the annular protrusion 5A of the muffler member 5, and the grooves 31 and 33. Accordingly, exhaust air stream can also be weakened and exhaust noise can also be reduced.

If the fastener driving operation is repeatedly performed with a reduced time interval, the muffler member 5 may be frozen to prevent the exhaust air from passing therethrough. However, since the air vent passages 6 are formed, the compressed air can be discharge outside through the air vent passages 6. In this case, the exhaust air stream can be weakened and exhaust noise can be reduced because of the above described crank-shaped vent passages 6. Moreover, the annular space 5*a* can further reduce the exhaust noise, because a large space is provided by the annular space 5*a* where the exhaust gas can expand prior to the discharge of the exhaust gas through the vent passages 6.

Figure 5:
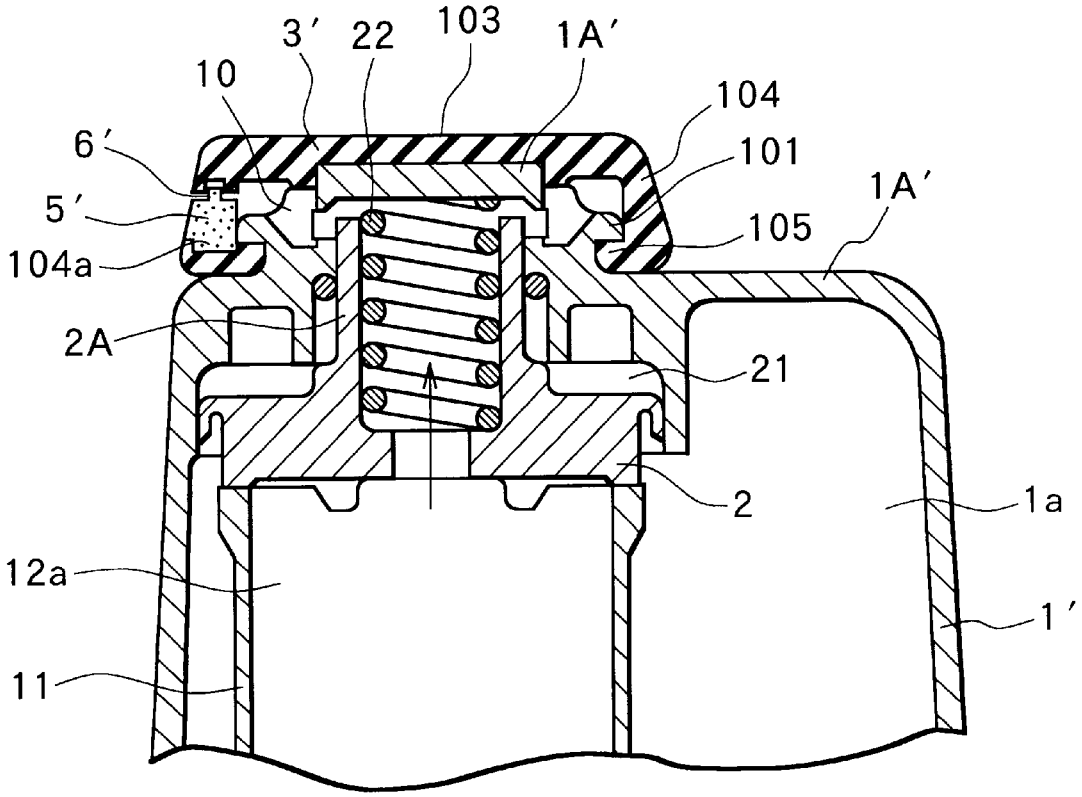
FIG. 5 is a cross-sectional view showing an upper essential portion of a pneumatic fastener driving tool according to a second embodiment of the present invention.

A pneumatic fastener driving tool according to a second embodiment will be described with reference to FIG. 5. In the first embodiment, the muffler member 5 is annular shape. However, it is unnecessary to make the shape of the muffler member 5 annular so as to surround the exhaust port 10. Instead, in the second embodiment, a cover member 3' can be formed by a circular top wall portion 103 and a skirt portion 104 extending from an outer peripheral end portion of the top wall portion 103. The skirt portion 104 has an engaging projection 105. Further, the upper wall portion 1A' of the main body 1' provides an engaging groove 101 with which the engaging projection 105 of the cover member 3' is engaged. Thus, the exhaust port 10 is surrounded by the skirt portion 104. The cover member 3' is formed of a rubber material so that the engaging projection 105 can be engaged with the engaging groove 101 by the elastic deformation of the cover member 3' during assembly.

At the skirt portion 104, at least one through-hole 104*a* is formed in which a muffler piece 5' having a complementary shape can be fitted. At the fitting surface between the through-hole 104*a* and the muffler piece 5', the above described crank-shaped air vent passages 6' can be formed.

While the invention has been described in detail and with reference to the specific embodiments thereof, it would be apparent to those skilled in the art that various changes and modifications may be made therein without departing from the spirit and scope of the invention. For example, in the first embodiment, four vent passages 6 are formed. However, the number of the vent passages is not limited to four.

Further, in the foregoing embodiments, the vent passages 6, 6' are formed between the lower surface of the exhaust cover 3, 3' and the upper surface of the muffler member 5, 5'. However, vent passages can be formed between the lower surface of the muffler member and the upper surface of the top wall 1A.

Furthermore, in the second embodiment, the engaging projection 105 can be slidingly movable with respect to the engaging groove 101. With this arrangement, a position of the muffler piece 5' can be changed by rotating the exhaust cover 3' relative to the upper wall portion 1A' of the main body 1'. Thus, the exhaust air can be directed toward an intended direction.

Furthermore, the foregoing embodiment concerns the head valve type pneumatic fastener driving tool. However, a cylinder valve type pneumatic fastener driving tool is also available in the present invention.

What is claimed is:

1. A pneumatic fastener driving tool comprising:

a main body formed with an exhaust port;

a cylinder disposed in the main body;

a drive piston reciprocally movably disposed in the cylinder;

a drive bit connected to the drive piston for driving a fastener in one direction, a compressed air being applied to the drive piston for its movement in the one direction;

a cover member attached to the main body portion; and a muffler member fixed at a position by the cover member and at a position outwardly of the exhaust port for allowing the compressed air which has been passing through the exhaust port to pass through the muffler member toward an atmosphere, at least one air vent passage being formed between a peripheral surface of the muffler member and one of the cover member and the main body for permitting the compressed air which has been passing through the exhaust port to be discharged toward the atmosphere through the at least one air vent passage.

2. The pneumatic fastener driving tool as claimed in claim 1, wherein the at least one air vent passage has a crank shape.

3. The pneumatic fastener driving tool as claimed in claim 2, wherein the cover member has a circular shape, and the muffler member has an annular shape, an annular space in communication with the exhaust port being defined inside the muffler member.

4. The pneumatic fastener driving tool as claimed in claim 3, wherein the muffler member has upper end face in contact with a lower surface of the cover member and a lower end face in contact with an upper surface of the main body, the lower surface of the cover member being formed with an annular groove, and the upper end face of the muffler member having a complementary annular projection engageable with the annular groove, the lower surface of the cover member being partly formed with a cranked groove in confronting relation to the upper end face of the muffler member, the cranked groove being cranked in the axial direction of the cover member and extending in a radial direction of the cylinder crossing the annular groove.

5. The pneumatic fastener driving tool as claimed in claim 2, wherein the cover member has a circular shape and is provided rotatably with respect to the main body.

6. The pneumatic fastener driving tool as claimed in claim 5, wherein the cover member has a circular top wall portion and a skirt portion extending downwardly from an outer peripheral end portion of the top wall portion to confront the exhaust port, the skirt portion being formed with at least one opening in which the muffler member is fitted, the at least one air vent passage being formed at the at least one opening.

7. The pneumatic fastener driving tool as claimed in claim 6, wherein the cover member is formed of a rubber, and wherein the skirt portion has an annular projection projecting radially inwardly, and the upper portion of the main body has an annular groove with which the annular projection is slidably engageable, whereby a position of the muffler member can be changed.

8. A pneumatic fastener driving tool comprising:

a main body having an upper portion formed with an exhaust port;

a cylinder disposed in the main body and extending in an axial direction and having an upper open end;

a drive piston reciprocally movably disposed in the cylinder for driving a fastener in one direction, a compressed air being applied to the drive piston for its movement in the one direction;

a head valve disposed within the main body and at a position above the cylinder, the head valve being movable in the axial direction of the cylinder for selectively closing and opening the exhaust port and opening and closing the upper open end of the cylinder;

a cover member attached onto the upper portion of the main body portion; and a muffler member fixed at a position by the cover member and at a position radially outwardly of the exhaust port for allowing the compressed air which has been passing through the exhaust port to pass through the muffler member toward an atmosphere, at least one air vent passage being formed between a peripheral surface of the muffler member and one of the cover member and an upper surface of the main body for permitting the compressed air which has been passing through the exhaust port to be discharged toward the atmosphere through the at least one air vent passage.

9. The pneumatic fastener driving tool as claimed in claim 8, wherein the at least one air vent passage has a crank shape.

10. The pneumatic fastener driving tool as claimed in claim 9, wherein the cover member has a circular shape, and the muffler member has an annular shape, an annular space in communication with the exhaust port being defined inside the muffler member.

11. The pneumatic fastener driving tool as claimed in claim 10, wherein the muffler member has upper end face in contact with a lower surface of the cover member and a lower end face in contact with the upper surface of the main body, the lower surface of the cover member being formed with an annular groove, and the upper end face of the muffler member having a complementary annular projection engageable with the annular groove, the lower surface of the cover member being partly formed with a cranked groove in confronting relation to the upper end face of the muffler member, the cranked groove being cranked in the axial direction of the cover member and extending in a radial direction of the cylinder crossing the annular groove.

12. The pneumatic fastener driving tool as claimed in claim 9, wherein the cover member has a circular shape and is provided rotatably with respect to the main body.

13. The pneumatic fastener driving tool as claimed in claim 12, wherein the cover member has a circular top wall portion and a skirt portion extending downwardly from an outer peripheral end portion of the top wall portion to confront the exhaust port, the skirt portion being formed with at least one opening in which the muffler member is fitted, the at least one air vent passage being formed at the at least one opening.

14. The pneumatic fastener driving tool as claimed in claim 13, wherein the cover member is formed of a rubber, and wherein the skirt portion has an annular projection projecting radially inwardly, and the upper portion of the main body has an annular groove with which the annular projection is slidably engageable, whereby a position of the muffler member can be changed.

* * * * *